US006067681A

United States Patent [19]

Zeinstra et al.

[11] Patent Number: 6,067,681

[45] Date of Patent: May 30, 2000

[54] HOSE BRIDGE

[75] Inventors: Eelco Franciscus Zeinstra, BM Franeker; Lucas Salomons, JZ Emmeloord, both of Netherlands

[73] Assignee: Kuiken N.V., Emmeloord, Netherlands

[21] Appl. No.: 09/195,452

[22] Filed: Nov. 18, 1998

[30] Foreign Application Priority Data

Nov. 19, 1997 [NL] Netherlands ..... 1007585

[51] Int. Cl.[7] ..... E01C 11/22; E01D 1/00

[52] U.S. Cl. ..... 14/69.5; 104/275; 138/106; 138/110

[58] Field of Search ..... 14/69.5; 404/15; 104/275, 277; 138/106, 110; 174/117 F, 117 FF

[56] References Cited

U.S. PATENT DOCUMENTS

| | | | |
|---|---|---|---|
| 1,137,313 | 4/1915 | Hamilton . | |
| 1,956,125 | 4/1934 | Leister . | |
| 2,134,393 | 10/1938 | Bennett . | |
| 2,166,516 | 7/1939 | Bainbridge . | |
| 3,888,186 | 6/1975 | Jentzsch et al. | 104/275 |
| 4,067,258 | 1/1978 | Valeri . | |
| 4,374,530 | 2/1983 | Walling | 138/110 |
| 5,267,367 | 12/1993 | Wegmann, Jr. . | |
| 5,353,843 | 10/1994 | Hoag | 138/110 |
| 5,385,431 | 1/1995 | Topf, Jr. . | |
| 5,566,622 | 10/1996 | Ziaylek, Jr. et al. | 104/275 |
| 5,755,527 | 5/1998 | Dufresne | 404/3 |

*Primary Examiner*—James A. Lisehora
*Attorney, Agent, or Firm*—Young & Thompson

[57] ABSTRACT

A hose bridge for bridging a hose extending over a surface, for example a fire hose for conveying water for extinguishing purposes, has a passage for the hose and defines a support surface that can rest on the surface. The transverse dimension of the passage in a direction transverse to the support surface is smaller than the nominal diameter of the hose and the circumferential dimension of the passage essentially corresponds to the circumferential dimension of the hose.

14 Claims, 2 Drawing Sheets

HOSE BRIDGE

FIELD OF THE INVENTION

The invention relates to a hose bridge for bridging a hose extending over a surface, for example a fire hose for conveying water for extinguishing purposes, which hose bridge has a passage for the hose and defines a support surface that can rest on the surface.

BACKGROUND OF THE INVENTION

A hose bridge of this type is disclosed in U.S. Pat. No. 4,067,258. Hose bridges are used for bridging (temporarily) laid out hoses in such a way that vehicles, such as lorries and fire engines, can cross the hoses without squashing these flat or damaging them. The hose bridges have an up and a down ramp, as a result of which the vehicles are able to drive over the hose without too much trouble.

The condition for this is, however, that the hose bridge is not too high. In the case of traditional fire hoses which have a diameter of 75 mm the difference in height is still restricted, so that the up and down ramps can be of a restricted length and the bridge can be put in place without many problems.

However, the disadvantage of the traditional hoses of restricted diameter is that the fluid transport is accompanied by substantial loss of energy. In practice, therefore, ever greater use is being made of hoses of a larger diameter, for example of 200 mm or even more. However, with hoses of this type the difference in height to be bridged by means of a hose bridge is so great that very long up and down ramps would have to be used. For a removable hose bridge this requirement leads to a complex, bulky and high, less stable hose bridge.

As a consequence of their size, such hose bridges would, moreover, not be able to be put in place in a simple and rapid manner, as a result of which the traffic, for example of fire engines, is seriously impeded and firefighting can progress less well.

SUMMARY OF THE INVENTION

The aim of the invention is, therefore, to provide a hose bridge which can be used with hoses of a large diameter and which nevertheless has a simple, relatively low construction. Moreover, the hose bridge must be suitable for both small and large hoses. The aim is achieved in that the transverse dimension of the passage in the hose bridge in a direction transverse to the supporting surface is smaller than the nominal diameter of the hose and the circumferential dimension of the passage essentially corresponds to the circumferential dimension of the hose.

Because the circumferential dimension of the hose is approximately equal to the corresponding dimension of the passage, the hose can be accommodated in the passage without folds. As a result the flow in the hose is disrupted to a lesser extent, whilst no folding can occur and the hose will also not rapidly become damaged as a consequence of the deformation.

The cross-section of the passage can be of various shapes. According to a simple embodiment, the transverse dimension of the passage in a direction parallel to the supporting surface is greater than said diameter.

Because the hose is deformed and is pressed flatter in the passage, the hose bridge according to the invention can be of low height. As a consequence of this low height, the up and down ramps can remain short, such that traffic is not impeded to too great an extent.

The hose is flattened by the hose bridge, which leads to a certain reduction in the surface area of the cross-section. Nevertheless, such a reduction does not result in too great an increase in resistance in the case of transport of fluid. This is because, in the case of laminar flows, the hose resistance is reasonably independent of the size of the surface area. However, the length of said surface that is embraced is important.

Furthermore, it is found that a reduction in the surface area of the hose over a short distance compared with the total length of the hose has little influence on the transport flow.

The flow in a hose changes from laminar flow to turbulent flow when the so-called critical flow rate is exceeded. In connection with the presence of couplings in the hose, the flow rate is therefore usually selected to be approximately 50% of the critical flow rate. Even when such couplings are present, no change-over to turbulent flow occurs in that case.

The transition from a circular hose cross-section to a flatter hose cross-section in general causes little disruption in comparison with, for example, the hose couplings, which have bumpers. Partly as a consequence of the fairly low nominal flow rate, which, after all, is approximately 50% of the critical flow rate, a higher flow rate can be permitted at the location of the reduced surface area, so that the nominal transport capacity can virtually be maintained.

The passage is located in a bridge section, which bridge section has a supporting wall on that side of the passage which faces the supporting surface and has a bridging wall on the opposing side of the passage, which supporting wall has a larger contact surface with the hose than does the bridging wall.

In operation, the hose located in the passage exerts a uniform pressure from one side on the adjoining wall. In view of the fact that the supporting wall has a larger contact surface with the hose than the opposing bridging wall, the bridge section will seek an equilibrium position which is shifted towards the supporting surface.

The hose bridge is therefore also at the desired low level, that is to say with the supporting surface on the surface, if the hose is under overpressure.

Such a larger contact surface of the supporting wall with the hose can, for example, be achieved if the supporting wall, viewed in the longitudinal direction of the passage, is longer than the bridging wall.

Preferably, the supporting wall facing the supporting surface has a descending, nose-shaped protrusion at its opposing ends in the longitudinal direction of the passage. The descending shape of the noses provides a gradual transition from the circular to the flattened cross-section of the hose.

Preferably, it must be possible to fit the hose bridge later on over a hose that has already been run out. To this end it has two shell sections which can be fitted laterally on the hose and can be fixed to one another against the resistance of the hose, which shell sections define a passage for the hose when they are fixed to one another.

According to a first possibility, the shell sections can comprise a supporting shell section, which faces the supporting surface, and an opposing bridging shell section.

According to a second possibility, the shell sections each have a supporting shell section half facing the supporting surface and an opposing bridging shell section half.

Upward-sloping ramp sections are also provided, as well as a central bridge section in which the passage is located, which ramp sections are detachably coupled to the bridge section.

When the hose bridge is in use, several bridge sections can be provided one after the other in the longitudinal direction. A pair of ramp sections is connected to every two bridge sections, which bridge sections are a distance apart which corresponds to the track width of a road vehicle.

BRIEF DESCRIPTION OF THE DRAWINGS

The invention will be explained in more detail below with reference to a few illustrative embodiments shown in the figures.

DETAILED DESCRIPTION OF THE INVENTION

Figure 1:
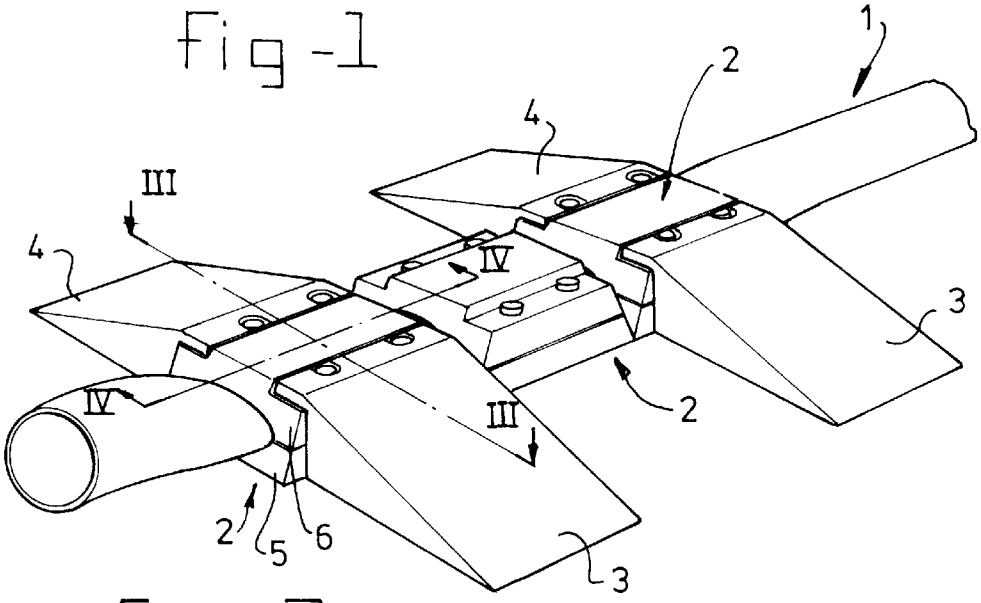
FIG. 1 shows a perspective view of a first embodiment of the hose bridge.

The hose bridge shown in FIG. 1 is fitted over a hose 1, for example a fire hose. The hose can, for example, have a cross-section of 20 cm.

The hose bridge has two bridge sections 2, an up ramp 3 and a down ramp 4 being connected to each bridge section. An additional bridge section 2 can be fitted between the bridge sections 2 in order to keep the up-ramps and down-ramps 3, 4 the correct distance apart such that a vehicle can drive over the hose 1.

In view of the large cross-sectional diameter of the hose 1, it is not easily possible to use normal hose bridges. With normal hose bridges, the hose runs through the bridge sections undeformed, with the consequence that the up and down ramps 3, 4 would be very long and high. The conventional hose bridge would also be high, which entails the risk of tilting.

Figure 3:
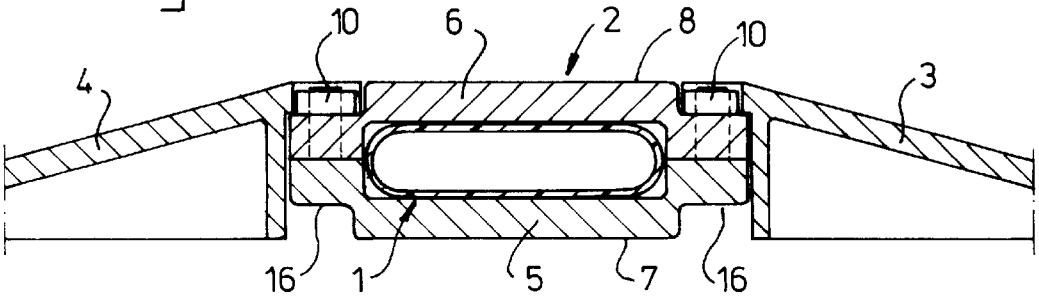
FIG. 3 shows a cross-section along III—III in FIG. 1.

As shown in FIGS. 1 and 3, the hose 1 is therefore compressed from the original circular shape to a flattened shape at the location of the hose bridge. It is true that such a flattened shape has a smaller flow cross-section than the normal circular shape, but the flow losses remain nevertheless restricted. In any event compared with the flow losses that already occur in a hose at the location of the couplings, no unjustifiably high losses occur at the location of the deformed cross-sections.

The bridge section 2 consists of two parts, specifically a supporting wall 5 and a bridging wall 6. The supporting wall 5 has a supporting surface 7, by means of which the bridge section rests on the substrate. The bridging section 6 has a drivable surface 8, on which the wheels of a vehicle can be supported.

In view of the high forces which a hose exerts on the supporting wall 5 and the bridging section 6 when it is in operation, the components are firmly fixed to one another by means of studs 9 and nuts 10. The studs 9 are fixed to the supporting wall 5 and inserted through correspondingly positioned holes 11 in the bridging wall 6.

As already mentioned, bridging of hoses of a large diameter can be achieved with the hose bridge according to the invention. Furthermore, the total height that a vehicle has to overcome in order to drive over such a hose remains restricted. It is therefore important that the drivable surface 8 of bridging section 6 remains at as low a level as possible. With this aim the total surface area of the bridging wall 6 which is in contact with the hose is chosen to be smaller than the total contact surface of the supporting wall 5 with the hose, as shown in FIG. 4.

As a consequence of this difference in surface areas, the bridge section 2 seeks an equilibrium position which is relatively low with respect to the hose 1, as a result of which supporting surface 7 is always in contact with the surface on which the hose 1 is also lying.

Figure 2:
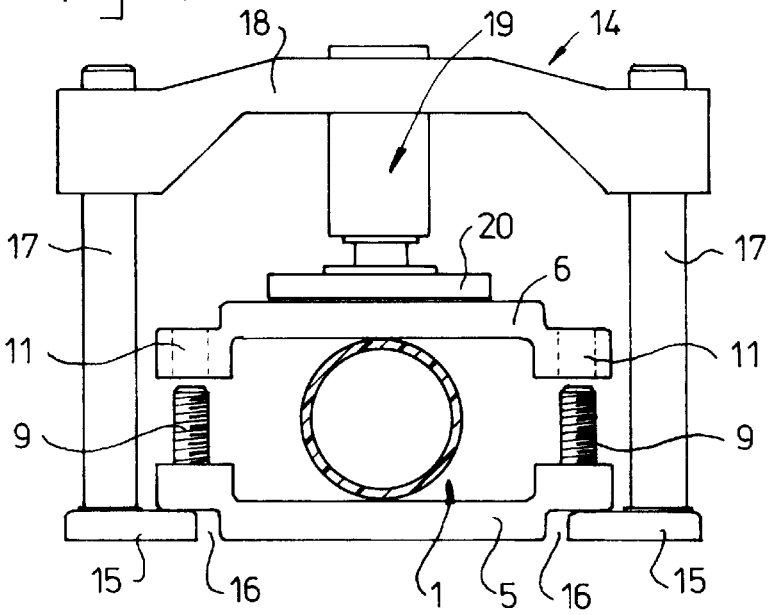
FIG. 2 shows a device for fitting the hose bridge.

The hose bridge according to the invention can be fitted over the hose when the latter has already been run out. As shown in FIG. 2, to this end the supporting wall 5 is placed under the hose 1. The bridging wall 6 is then placed on the hose. So as to be able to press the bridging wall 6 firmly onto the supporting wall 5, the press installation indicated in its entirety by 14 is provided. This press installation has two feet 15, which can be fitted into recesses 16 in the supporting wall 5. Columns 17, which carry a yoke 18, are mounted on said feet. A hydraulic press 19 is fitted in the yoke 18, which hydraulic press is able to press the bridging wall 6 onto the supporting wall 5 via pressure plate 20, after which the nuts 10 can be fitted.

Figure 4:
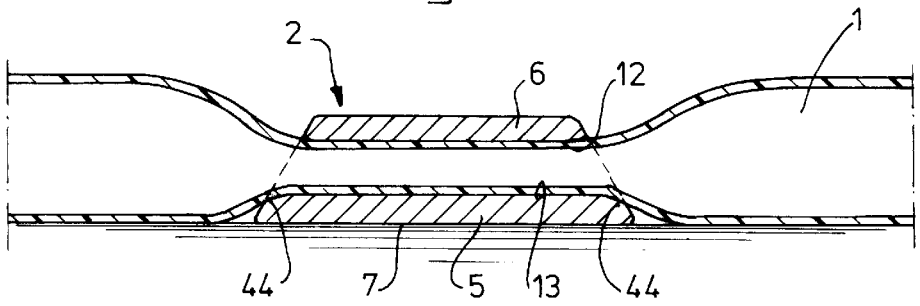
FIG. 4 shows a longitudinal section along IV—IV in FIG. 1.

In the longitudinal section in FIG. 4 it is shown that the supporting wall 5 has two downward-sloping noses 44. These provide the desired enlargement of the contact surface with the hose 1 and provide a gradual transition.

Figure 5:
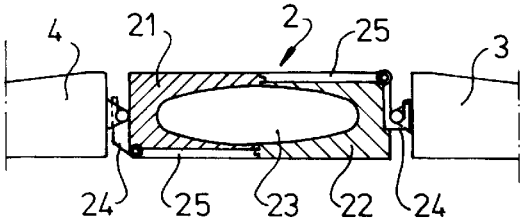
FIGS. 5–8 show further embodiments.

The variant shown in FIG. 5 shows (partially) a supporting bridge with two halves 21, 22, which can be slid laterally over the hose. The two halves 21, 22 define an oval-shaped space within which the hose can be accommodated. With this embodiment the bridge sections 21, 22 must be fitted over the hose while the latter is still not under pressure.

The two bridge sections 21, 22 are firmly fixed to one another by means of clamps 24 and tensioning rods 25.

The up ramp 3 and down ramp 4 can be coupled to the clamps 24.

Figure 6:
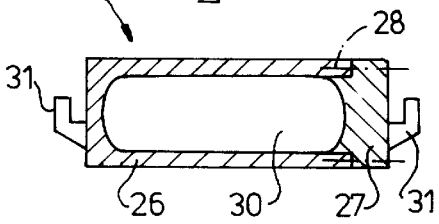

The embodiment in FIG. 6 shows a bridge section 2 consisting of a U-shaped section 26 and a closing section 27. The closing section has pins 28, which can be inserted into correspondingly shaped holes 29 in the arms of the U-shaped section 26. The hose can be accommodated in the recess 30. The up ramp and down ramp (not shown) can be attached by means of hooks 31.

Figure 7:
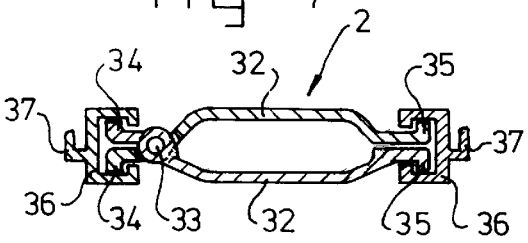

FIG. 7 shows a bridge section 2 consisting of two parts 32, which are joined by means of hinge 33. At their ends located close to the hinge 33, the parts 32 have hooks 34 which are offset with respect to one another; hooks 35 are also provided at the other ends of said parts.

Clamps 36, each having a hook section 37 for attaching an up ramp and down ramp, which are not shown, can be slid over said hooks 34, 35.

Figure 8:
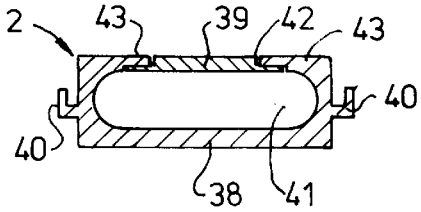

The bridge section 2 in FIG. 8 consists of a trough-shaped support 38 having an undercut chamber 41. The opening 42 of the trough-shaped chamber can be closed off by means of a cover 39, that bears against the inside of the inward-pointing walls 43 of the trough. An up ramp and down ramp, which are not shown, can be coupled to the hooks 40.

What is claimed is:

1. Hose bridge for use in bridging a hose having an outer diameter, the hose bridge comprising:

a supporting surface structured and arranged to rest on a substrate; and a passage extending in a longitudinal direction through said hose bridge for receiving the hose;

said passage having a height transverse to said supporting surface and smaller in magnitude than the outer diameter of the hose, and an interior circumference which is substantially the same size as the outer circumference of the hose when said hose is received within the passage.

2. The hose bridge according to claim 1, wherein the passage has a transverse dimension parallel to the supporting surface and greater than said outer diameter.

3. The hose bridge according to claim 1, wherein the cross section of the passage is substantially oval.

4. The hose bridge according to claim 1, wherein the passage is located in a bridge section; said bridge section having a supporting wall on a first side of the passage directly adjacent to the supporting surface and a bridging wall on an opposing side of the passage; said supporting wall having a larger contact surface with the hose than does the bridging wall, when said hose is received in the passage.

5. The hose bridge according to claim 4, wherein the supporting wall, viewed in the longitudinal direction of the passage, is longer than the bridging wall.

6. The hose bridge according to claim 5, wherein the supporting wall has opposing ends in the longitudinal direction of the passage, said supporting wall having a descending, nose-shaped protrusion at said opposing ends.

7. The hose bridge according to claim 1, wherein the passage has a first side directly adjacent to the supporting surface and an opposite second side, said first side being longer than the opposite second side.

8. The hose bridge according to claim 1, wherein the bridge is comprised of two shell sections structured and arranged to fit laterally on the hose and to be fixed to one another against the resistance of the hose, said shell sections defining the passage for the hose when fixed to one another.

9. The hose bridge according to claim 8, wherein the shell sections comprise a supporting shell section, which is directly adjacent to the supporting surface, and an opposing bridging shell section.

10. The hose bridge according to claim 8, where in the shell sections each have a supporting shell section half directly adjacent to the supporting surface and an opposing bridging shell section half.

11. The hose bridge according to claim 1, further comprising upward-sloping ramp sections and a central bridge section, said passage being located in said central bridge section.

12. The hose bridge according to claim 11, wherein the ramp sections are detachably coupled to the bridge section.

13. The hose bridge according to claim 12, wherein a pair of ramp sections is connected to every two bridge sections, said bridge sections being positioned a distance apart which corresponds to a track with the road vehicle.

14. The hose bridge according to claim 11, wherein several bridge sections are provided in pairs one after the other in the longitudinal direction.

* * * * *